United States Patent [19]

Yoshimura

[11] Patent Number: 4,575,323

[45] Date of Patent: Mar. 11, 1986

[54] SLIDE VALVE TYPE SCREW COMPRESSOR

[75] Inventor: Shoji Yoshimura, Hyogo, Japan

[73] Assignee: Kabushiki Kaisha Kobe Seiko Sho, Kobe, Japan

[21] Appl. No.: 613,224

[22] Filed: May 23, 1984

[51] Int. Cl.[4] ..... F01C 1/16

[52] U.S. Cl. ..... 418/201; 417/440

[58] Field of Search ..... 418/201-203; 417/310, 440

[56] References Cited

U.S. PATENT DOCUMENTS

| | | | |
|---|---|---|---|
| 3,088,659 | 5/1963 | Nilsson | 418/159 |
| 4,042,310 | 8/1977 | Schibbye | 418/201 |
| 4,234,296 | 11/1980 | Matsubara | 418/201 |
| 4,388,048 | 6/1983 | Shaw | 418/201 |

*Primary Examiner*—Leonard E. Smith
*Assistant Examiner*—Jane E. Obee
*Attorney, Agent, or Firm*—Oblon, Fisher, Spivak, McClelland & Maier

[57] ABSTRACT

A slide valve type screw compressor having a slide valve with a surface of chevron shape in section consisting of a couple of arcuately curved surfaces forming part of the inner wall surfaces of a rotor chamber accommodating a pair of intermeshed male and female screws, the slide valve being slidable in the axial direction of the rotors for communicating the rotor chamber with a suction port through an opening with an adjustably variable area for volumetric control of the compressor, characterized in that the slide valve is retractably protruded into a suction casing at a fore end on the side of the suction port and has the opposite outer corner portions of the curved surfaces cut off at a predetermined angle with the longitudinal axis thereof to provide a substantially triangular section with a forwardly reduced width at the protruded fore end.

7 Claims, 48 Drawing Figures

SLIDE VALVE TYPE SCREW COMPRESSOR

BACKGROUND OF THE INVENTION

1. Field of the Invention

This invention concerns a slide valve type screw compressor.

2. Description of the Prior Art

As illustrated in FIGS. 1 and 2, a screw compressor is generally provided with a pair of male and female screw rotors 5 and 6 (hereinafter referred to simply as "rotors" for brevity) which are rotatable in a meshed state within a compression chamber 8 in main casing 7. One end face of the compression chamber 8 is partly cut away at a position corresponding to tooth grooves of the rotors 5 and 6 to provide an opening 10 (an axial port) in communication with a suction port 11 through a suction casing 7*a*. The other end face is similarly provided with an opening, although different in shape, for communication with a discharge port 12. Further, provided beneath the compression chamber 8, partly in overlapped relation therewith, is a columnar gap space in communication with the suction port 11, slidably receiving therein a slide valve 31 (of a length $L_1$) in the axial direction of the rotors. The slide valve 31 is provided with curved surfaces each of an arcuate shape in section which constitute part of the inner wall surface of the compression chamber 8, and its forward movement is limited by a fixed valve 31*a* which is located in a forward position.

In this sort of screw compressor, a gas which is sucked in through the suction port 11 is closed off and compressed in the compression chamber 8 between the rotors 5 and 6 and the casing 7, and then sent toward the discharge port 12, while the slide valve 31 is retractable to open a radial port 13 of a variable area in the wall of the compression chamber 8 for communicating the compression chamber 8 with the suction port 11, permitting volumetric control through adjustment of the initial closing position of the rotors 5 and 6.

However, as shown in FIGS. 3 and 4, the conventional slide valve 31 has end face 33 on the side of the suction port formed by a flat surface which is disposed perpendicular to the sliding direction, so that is has been difficult to preclude an abrupt and discontinuous variation in the volume of a closed space (hereinafter referred to simply as "suction volume" for brevity) at an initial closing point even if the radial port 13 is opened little by little in the initial stage of a volumetric control.

Now, the above-mentioned discontinuous variations are explained more particularly with reference to FIGS. 5 and 6 which show at (a) to (f), respectively, sequential phases of the rotation of the rotors.

More specifically, FIG. 5 shows at (a) to (f) varying conditions at the end of the compression chamber on the side of the suction port 11 in relation with rotation of the rotors. As the operation proceeds from phase (a) to (f), the rotors 5 and 6 are rotated successively in the arrowed directions, gradually compressing a closed space 14 which is indicated by a hatched area. In this instance, the closed space 14 is the one which is formed when the aforementioned radial port 13 is in a closed state (so that the latter does not appear in FIG. 5), and, for simplification of explanation, there is shown a case where the width W (illustrated in FIG. 2) of a lower projection 18 which forms the opening 10 in the end face 17 or which closes the ends of the screw root ends of the rotors 5 and 6 is equal to the width w (illustrated in FIG. 3) of the curved surfaces 2 of the slide valve 31.

Shown at (a) to (f) of FIG. 6 are developed views of sections taken along line VI—VI of FIG. 5, which correspond to phases (a) to (f) of FIG. 5. As shown there, an end face 33 of the slide valve 31 is positioned on the side of the suction port 11 and outside the compression chamber 8, closing the radial port 13 with the curved surfaces 2. (Therefore, the radial port 13 does not appear in FIG. 6.) The hatched areas in FIG. 6 indicate a closed space 14 corresponding to the hatched areas in FIG. 5, which is gradually shifted upward from phase (a) to (f) of FIG. 6. On the other hand, the closed space 14 reaches an end face 19 on the discharge side and the end of the discharging side is closed while the end face 19 is rotated through a predetermined angle, so that the volume of the closed space 14 is reduced to compress the gas gradually from phase (a) to (f) of FIG. 6.

Referring to FIG. 7, the slide value 31 is shown in a position which is slightly moved from that of FIG. 6 with its end face 31 located a little closer to the discharging side (the upper side in the figure) than the end face 17 of the compression chamber 8, with the radial port 13 in a slightly opened state, illustrating variations of the closed space in this position from phase (a) to (f) corresponding to the phases shown in FIG. 6. In this case, a portion corresponding to the closed space 14 is in communication with the suction port 11 through the radial port 13 as indicated by a dotted area in phases (a) to (d) of FIG. 7, so that it is only in and after phase (e) that a closed space 15 is formed as indicated by an hatched area. Namely, the lowermost point M (a closing point) of a V-shaped hatched area, at which the male and female rotors 5 and 6 contact with each other, is gradually shifted inward across the end face 17 of the compression chamber 8 and it is only when the closing point M reaches the end face 33 of the slide valve 31 that a closed space 15 is formed.

Therefore, the suctioning volume corresponds to the closed space 14 in phase (a) in the position of FIG. 6 and corresponds to the closed space 15 in phase (e) in the position of FIG. 7. Thus, the suction volume is abruptly varied discontinuously or stepwise from the volume in phase (a) of FIG. 6 to the volume in phase (e) of FIG. 7 (the same as that of the closed space in phase (e) of FIG. 6) upon opening the radial port 13 only in a slight degree. Even if the radial port 13 is further minimized, the result is that the position of the lowermost point M comes nearer to the end face 17 but the closed space 15 is not yet formed in phase (d) of FIG. 7 and is formed also in phase (e) of the same figure, resulting likewise in a suction volume which is varied discontinuously from the state in phase (a) of FIG. 6.

If the radial port 13 is widened by shifting the slide valve 31 toward the discharge end, the position of the lowermost point M which represents the initial closing point is shifted upward to reduce the suction volume continuously.

As is clear from the foregoing description, the suction volume is varied as indicated by curve II of FIG. 8, in which the horizontal axis represents a distance l of displacement of the slide valve 31, namely, the distance between the end faces 17 and 33 in the particular embodiment shown, and the vertical axis represents the rate (%) of the suction volume at various distances l of displacement to the suction volume in the state shown in FIGS. 5 and 6 (a state in which the radial port 13 is closed.)

As seen therefrom, curve II consists of a vertical portion AB and an inclined portion BC. The point A represents a state in which the end faces 17 and 38 are located in the same plane (distance of displacement l=0) with the radial port 13 closed, the point B represents a state in which opening of the radial port 13 has just been initiated or when the distance in phase (e) of FIG. 7 is infinitesimal, and the point C represents a state in which the radially port 13 has been further continuously widened. Thus, upon opening the radial port 13, the curve II is varied discontinuously from point A to B.

On such a discontinuous variation, a compressing gas which is of a relatively large mass like air shows an inferior response to the variation due to a greater frictional resistance, so that an apparent suction volume is varied continuously in response to displacement of the slide valve 31 as indicated by curve III (broken line) in FIG. 8. Namely, actually the suction volume can be controlled from the maximum value by gradually shifting the slide valve 31.

However, in a case where a light gas like hydrogen and helium is employed as a compressing gas, the gas has a low frictional resistance and shows a quick response to the aforementioned discontinuous variation, so that the apparent suction volume is varied discontinuously as indicated by curve II. Consequently, it has been difficult for the conventional screw compressor to control the suction volume of a light gas continuously in the initial state of the control.

SUMMARY OF THE INVENTION

With the foregoing in view, the present invention has as its object the provision of a slide valve type screw compressor which can vary a suction volume theoretically in a continuous manner throughout a volumetric control including an initial point of the control whether or not a compressing gas is a light gas.

It is a more particular object of the present invention to provide a slide valve type screw compressor in which the slide valve is cut off at the opposite outer corner portions of its upper curved surfaces at a predetermined cut angle to ensure continuous control of the suction volume.

According to the present invention, there is provided a slide valve type screw compressor having a slide valve with a surface of chevron shape in section consisting of a pair of arcuately curved surfaces forming part of the walls of a compression chamber accommodating a pair of intermeshed male and female screws, the slide valve being slidable in the axial direction of the rotors for communicating the rotor chamber with a suction port through an opening with an adjustably variable area for volumetric control of the compressor, characterized in that the slide valve is retractably protruded into a suction casing at the fore end thereof located on the side of the suction port and has the opposite outer corner portions of the curved surfaces cut off at a predetermined angle with the longitudinal axis thereof to provide a substantially triangular section with a forwardly reduced width at the protruded fore end.

The above and other objects, features and advantages of the present invention will become apparent from the following description and appended claims, taken in conjunction with the accompanying drawings which show by way of example a preferred embodiment of the invention.

DETAILED DESCRIPTION OF THE PREFERRED EMBODIMENTS

Figure 3:
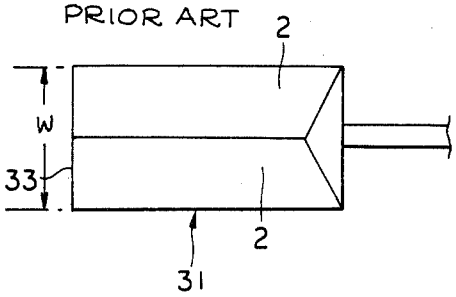
FIGURE 3 PRIOR ART
FIGS. 3 and 4 are a plan view and a front view of a conventional slide valve.
Figure 4:
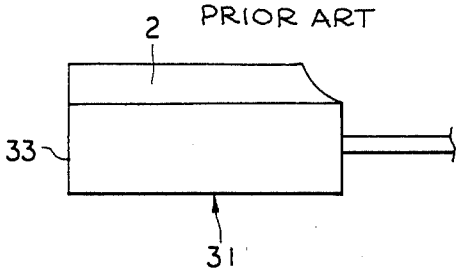
FIGURE 4 PRIOR ART
Figure 5A:
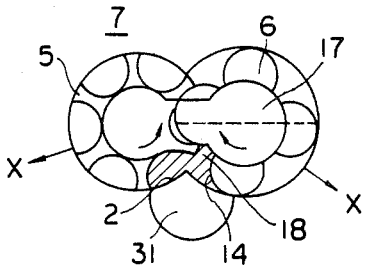
FIG. 5 is a diagrammatic illustration showing rotational positions of rotors in phases (a) to (f), seen from an end on the suction side of the screw compressor.
Figure 5B:
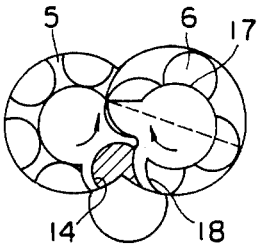
Figure 5C:
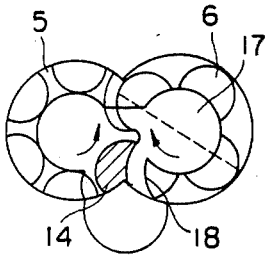
Figure 5D:
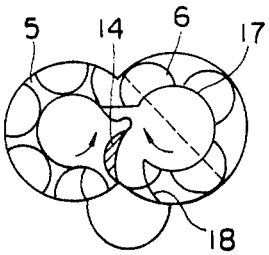
Figure 5E:
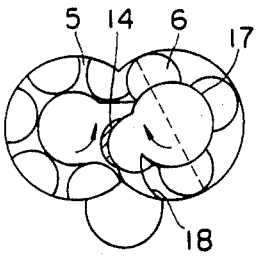
Figure 5F:
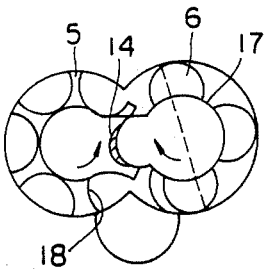
Figure 6A:
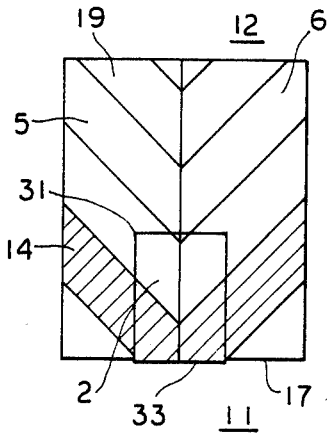
FIGS. 6(*a*) to 6(*f*) are developed sectional views taken on line VI—VI of FIG. 5 (in which the line of section is indicated in FIG. 5(*a*) alone)
Figure 6B:
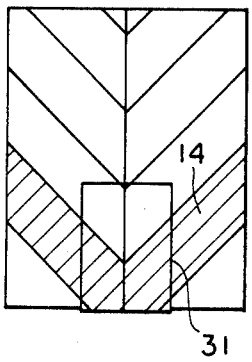
Figure 6C:
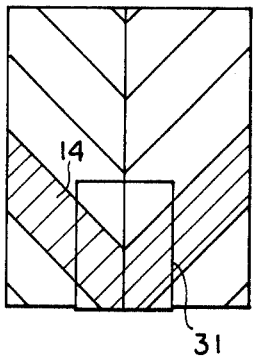
Figure 6D:
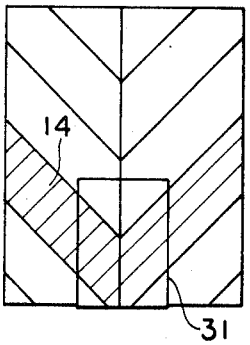
Figure 6E:
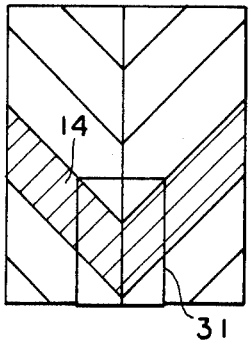
Figure 6F:
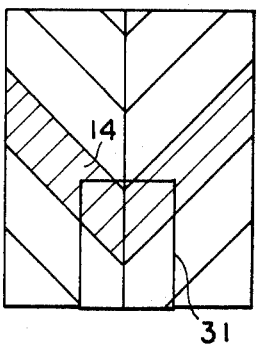
Figures 7A, 7B, 7C:
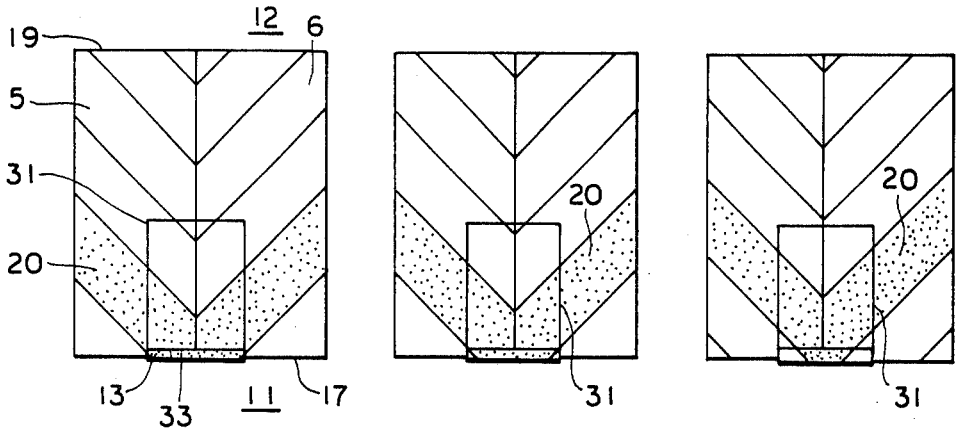
FIG. 7 is an illustration similar to FIG. 6 but showing the conventional slide valve in a shifted position.
Figures 7D, 7E, 7F:
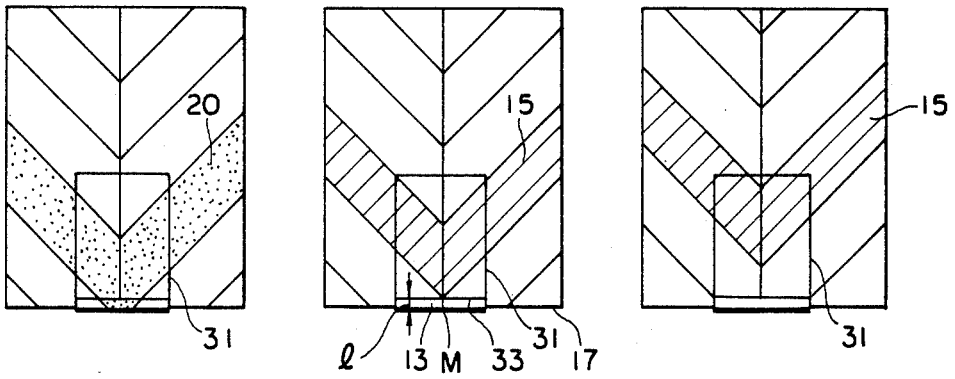
Figure 9:
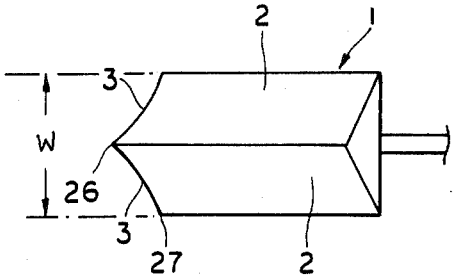
FIGS. 9 and 10 are a plan view and a front view of a screw compressor employing a slide valve according to the present invention.
Figure 10:
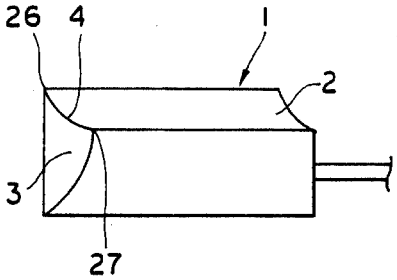

Referring to FIGS. 9 and 10, there is shown a screw compressor slide valve 1 (with a length $L_2$) according to the present invention, which is substantially the same as the slide valve 31 of FIGS. 3 and 4 in construction except for the shape of the end face 33 on the suction side.

More particularly, the slide valve 1 is provided with a surface of chevron shape in section having arcuately curved surfaces 2 formed on opposite sides of an apex 26, which constitute part of the wall of the compression chamber 8 as stated hereinbefore, and has end faces 3 on the suction side shaped such that the lines of intersection 4 with the curved surfaces 2 are inclined in the direction of screw threads of rotors 5 and 6. The slide valve 1 is received in a suction casing 7*a* which is provided with a stopper 23 to permit the valve end on the suction side (or the fore end of the valve) to retractably protrude into the suction casing 7*a*.

Figure 1:
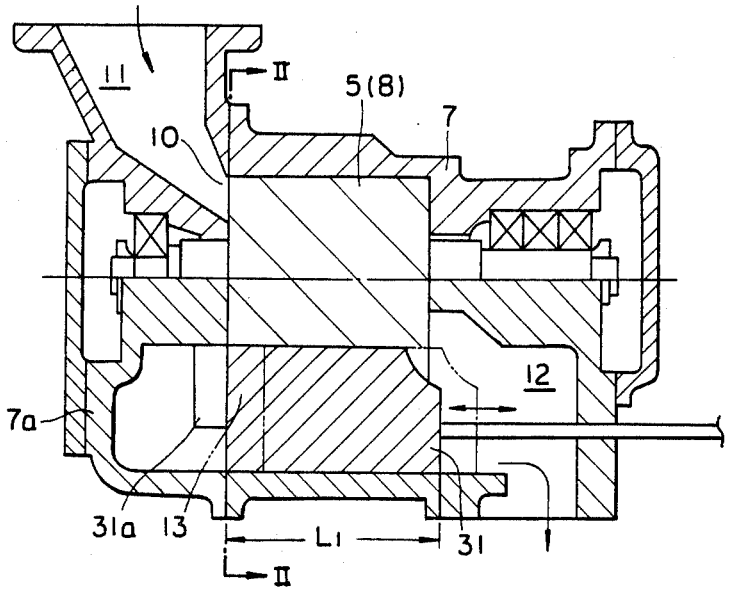
FIG. 1 is a vertical sectional of a conventional slide valve type screw compressor.
Figure 2:
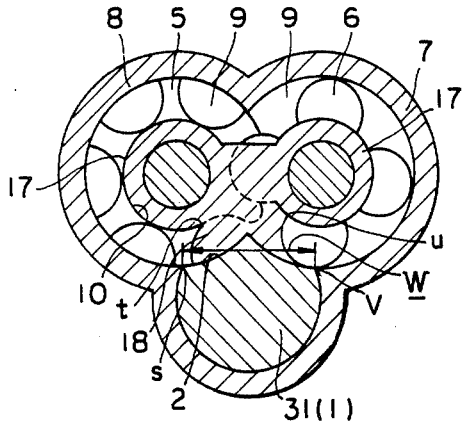
FIG. 2 is a sectional view taken on line II—II of FIG. 1.
Figure 11:
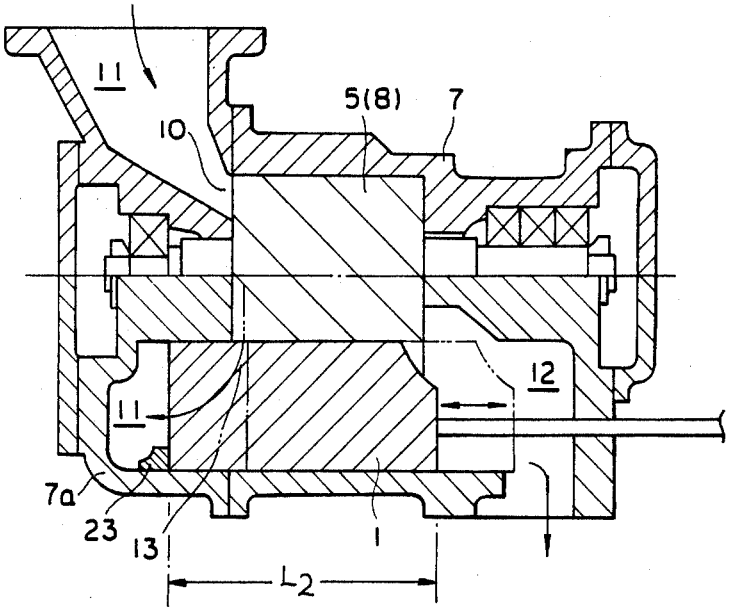
FIG. 11 is a vertical section of the slide valve type screw compressor embodying the present invention.

FIG. 11 shows a screw compressor incorporating the slide valve according to the invention, which is same in construction as the screw compressor of FIGS. 1 and 2 except that the slide valve 1 and stopper 23 are employed in place of the slide valve 31 and fixed valve 31*a*, respectively. The component parts which are common to the example shown in FIGS. 1 and 2 are designated by common reference numerals, and their description is omitted to avoid unnecessary repetition. Further, the reference numeral of the slide valve 1 is indicated in brackets in FIG. 2 so that the latter can serve also as a side view of the compressor of FIG. 11.

Figures 12A, 12B, 12C:
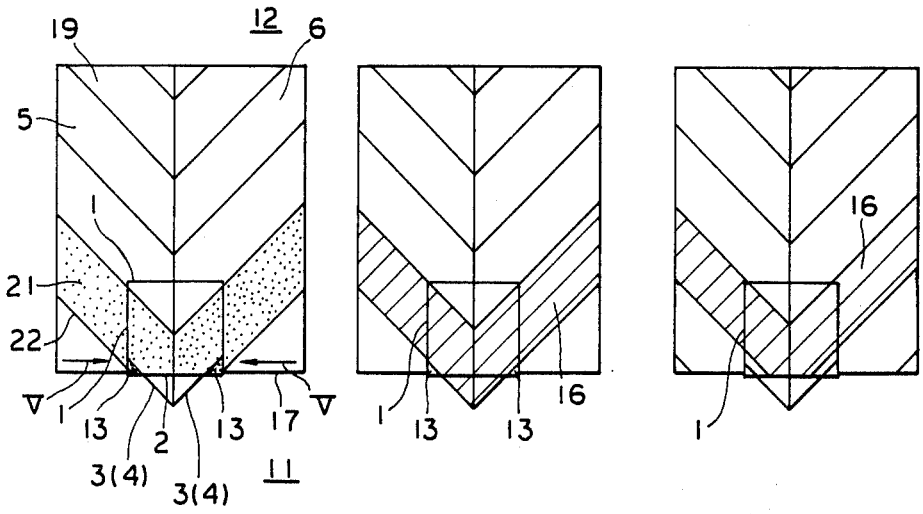
FIGS. 12(*a*) to 12(*f*) are views similar to FIGS. 6(*a*) to 6(*f*) but showing the rotational positions in the screw comppressor according to the invention.
Figures 12D, 12E, 12F:
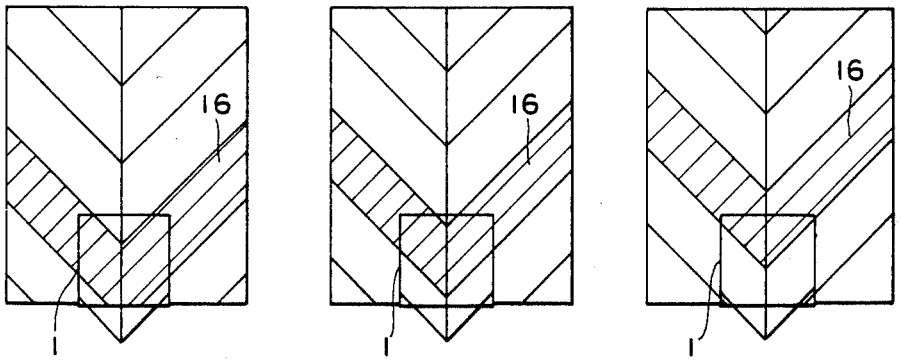

Now, variations in suction volume which are caused by shifts of the slide valve 1 are explained by way of phases (a) to (f) shown in FIG. 12.

As described hereinabove, the lines of intersection 4 are inclined in the direction of screw threads of rotors 5 and 6, so that each intersecting line 4 is disposed parallel with a line 22 of a screw thread (which comes out in a straight line in a developed view.) Consequently, as the slide valve 1 is gradually shifted upward in FIG. 12, a radial port 13 is opened on the opposite sides of the slide valve 1 in a manner similar to the rotor grooves which are moving toward the center (in the directions of arrows V) on the end face 17.

Figure 13A:
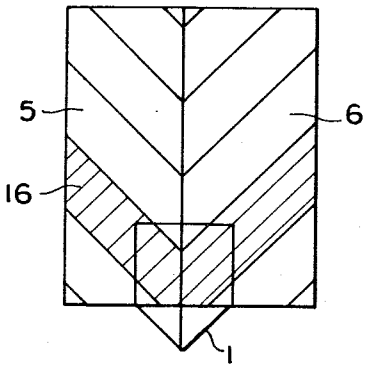
FIGS. 13(*a*) to 13(*c*) are developed sectional views taken on line VI—VI mentioned above, showing the extent of opening of the radial port in relation with the position of the slide valve.
Figure 13B:
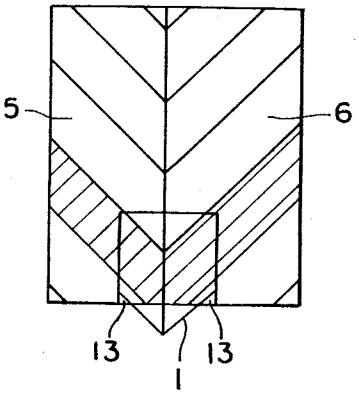
Figure 13C:
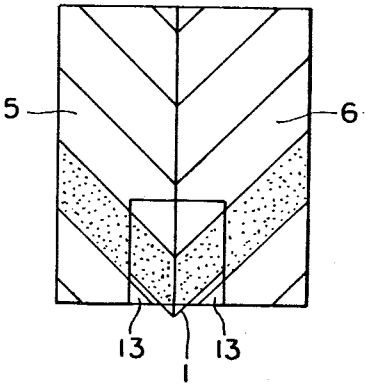

Shown in FIGS. 13(*a*) to 13(*c*) is an example of the varying condition of the radial port 13, which is observed, for instance, when the slide valve 1 alone is moved upward in the state of FIG. 12(*c*). As is clear therefrom, the radial port 13 is in a fully closed state and does not appear in FIG. 13(*a*), but is gradually widened from FIGS. 13(*b*) to 13(*c*). Consequently, the closed space 16 of FIGS. 13(*a*) and 13(*b*) is uncovered in FIG. 13(*c*), resuming a state prior to closing.

Therefore, in FIGS. 12(A) to 12(*f*) which show the radial port 13 in the initial stages of the opening operation, the portion which corresponds to the closed space 14 of FIGS. 5 and 6 is indicated by a dotted area 21 in FIG. 12(*a*). This area 21 is in communication with the suction port 11 through radial ports 13, and does not yet close in a gas. However, in phases (b) to (f), a closed space 16 which extends toward the center is formed beyond the radial ports 13 as indicated by hatching.

The volume of the closed space 16 (or the suction volume) in phase (b) of FIG. 12 at the initial closing point can be adjusted to approach the volume of the closed space 14 in phase (a) of FIGS. 5 and 6 (the maximum suction volume) by minimizing the radial ports 13. That is to say, as the slide valve 1 is shifted upward in the drawing from the fully closed position to open the radial ports 13, the suction volume is continuously reduced from the maximum value at the fully closed position (the value in phase (a) of FIGS. 5 and 6).

Figure 8:
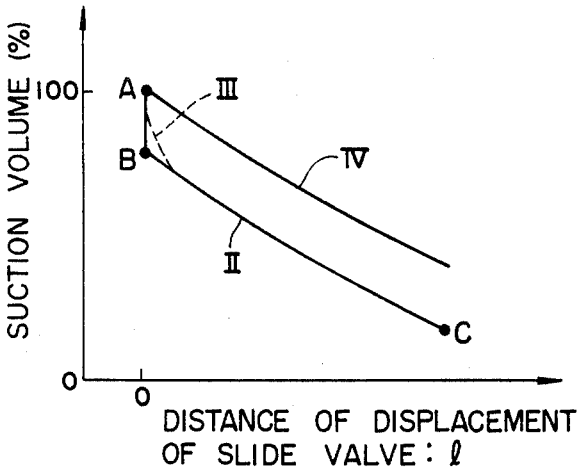
FIG. 8 is a graph showing variations in suction volume.

The variations in suction volume in the case of the slide valve 1 are plotted by curve IV in the graph of FIG. 8, from which it will be seen that the suction volume is reduced from the point A smoothly and linearly in response to increases in the distance of shift of the slide valve 1. In this graph, $l=0$ means a position of the slide valve 1 immediately before opening the radial ports 13.

Although the width w of the curved surface 2 of the slide valve 1 is shown and described as being equal to the width W of the lower projection 18 on the end face 17, the invention is not limited to this particular arrangement and can produce similar effects, for example, in a case where $w>W$ except for a change in the initial position of the slide valve 1 for the volumetric control. On the contrary, in a case where $w<W$, there occurs a slight discontinuous variation at an initial point of the volumetric control but it is far smaller than the discontinuous variation from point A to B of FIG. 8.

Further, the fore end portion as a whole of the slide valve 1 is shaped in an inclined form in the foregoing embodiment with the lines of intersection 4 of the end face 3 disposed in the direction of screw threads of the rotors 5 and 6. However, if desired, the corner portions of curved surfaces 2 on the side of the suction port may be partly cut off, or the intersecting lines 4 may be disposed in the same direction at an angle different from the lead angle of the screw threads of the rotors. In such a case, similarly a slight discontinuous variation occurs to the suction volume.

Figure 26:
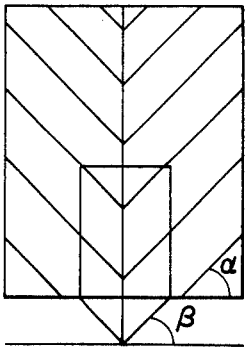
FIG. 26 is a view similar to FIG. 13 but showing a slide valve with a different cut angle.

The cutting angle $\beta$ of the end face 3 of the slide valve 1 is determined depending upon the controllability of a compressing gas and the structural factors of the compressor. Where especially a higher controllability is required, a cuting angle $\beta$ greater than a lead angle $\alpha$ of the rotor screws is employed as shown particularly in FIG. 26.

Figure 14:
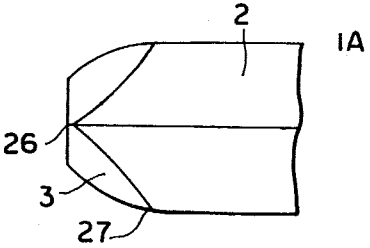
FIGS. 14 to 25 are fragmentary plan and front views, respectively, of slide valves of modified constructions.

The end faces 3 of the slide valve 1 which are inclined as a whole in the direction of the screw threads of the rotors 5 and 6 in the foregoing embodiment may be formed in other shapes as exemplified in FIG. 14 and onwards wherein the component parts common to the foregoing embodiment are designated by common reference numerals.

Figure 15:
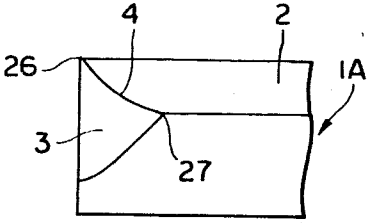

In a modification shown in FIGS. 14 and 15, the slide valve 1A has intersecting lines 4 common to the above-described valve body 1 but is provided with end faces which are cut obliquely from the intersecting lines 4 with a suitable gradient to present substantially a shape of trigonal pyramid, instead of the vertically cut end faces.

Figure 16:
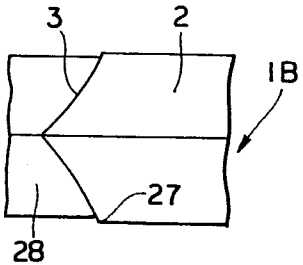
Figure 17:
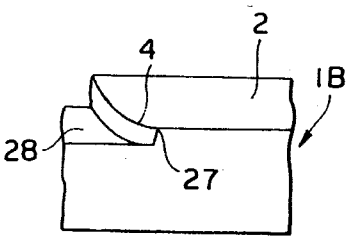

Referring to FIGS. 16 and 17, there is shown a modification wherein the slide valve 1B has intersecting lines 4 common to the slide valve 1 but it is provided with vertically cut end faces 3 which are terminated at a level halfway or less through the height of the valve body. According to the present invention, the apex 26 of the curved surfaces which form part of the rotor chamber is located closer to the suction port than the lateral corner portions 27, so that the shape of the fore extension 28 which contiguously extends beneath or forward (leftward in the drawing) of the end faces 3 is determined according to the shape of the suction casing 7*a* or the kind of the gas to be handled.

Figure 18:
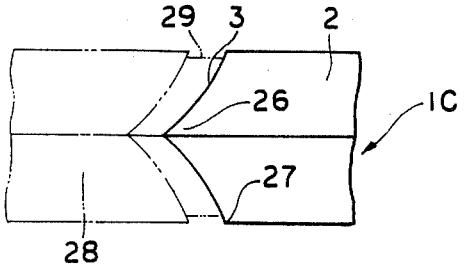
Figure 19:
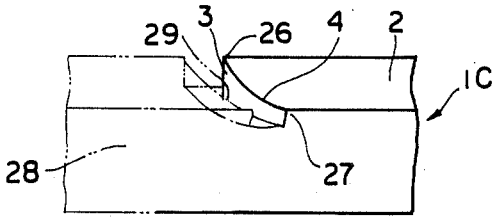

Accordingly, the front portion of the fore extension 28 may have the same sectional shape as the body of the slide valve 1B (except its cut portions) as seen in a modification shown in FIGS. 18 and 19. In this case, a groove 29 of a substantially V-shape is cut on the upper side of the body of a slide valve 1C of a length slightly greater than the length $L_2$ indicated in FIG. 11, and, as shown in FIGS. 18 and 19, the slide valve 1C is provided with curved surfaces 2 the same as those on the slide valve 1 and, integrally on the front side of the V-cut groove 29, a fore extension 28 which has the same sectional shape as the body of the slide valve 1C is indicated in phantom. In FIGS. 18 and 19, in order to distinguish the curves surfaces 2 from the fore extension 28, they are indicated by solid and chain lines, respectively.

Figure 20:
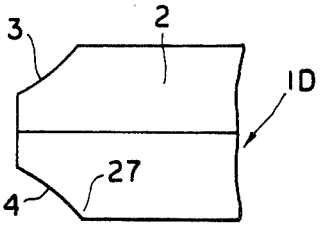
Figure 21:
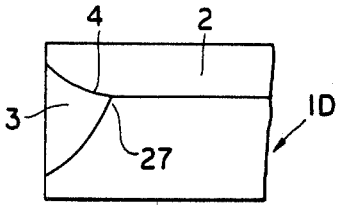
Figure 22:
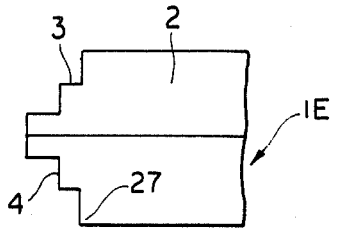
Figure 23:
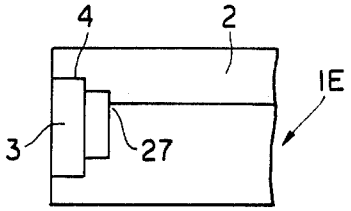
Figure 24:
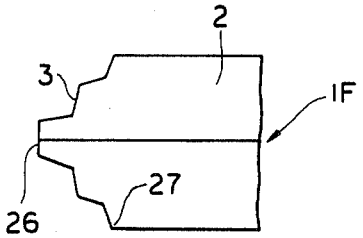
Figure 25:
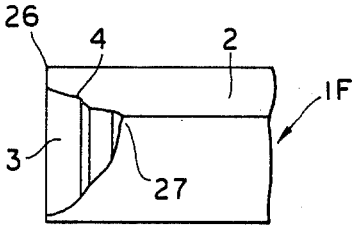

Referring to FIGS. 20 and 21, there is shown a further modification employing a slide valve 1D which is inclined in the directions of screw threads only in the outer edge portions of the end faces 3.

Shown in FIGS. 22 to 25 are slide valves 1E 1F which have the intersecting lines 4 formed in a zig-zag fashion and inclined as a whole in the direction of the screw threads.

Although the end faces 3, more particularly, the intersecting lines 4 are inclined to conform with the directions of screw threads of the rotors in the foregoing embodiments, it is not always required to conform the angle of inclination with the screw threads as long as the apex 26 of the curved surfaces 2 is located closer to the suction end of the rotor chamber than the outer corner portions 27. In the situation where the angle of inclination does not conform with the directions of the screw threads, a slight discontinuous variation occurs to the suction volume as mentioned hereinbefore in connection with the relationship between widths w and W.

Further, the curved surfaces 2 are not necessarily required to be disposed symmetrically on the opposite sides of the longitudinal axis of the slide valve 1 (or any of the slide valves 1A to 1F). When the slide valve 1 is located eccentrically relative to the compression chamber 8, the apex 26 is positioned off the center axis of the compression chamber.

As is clear from the foregoing description, the slide valve according to the present invention has outer corner portions of upper curved surfaces cut off, so that, when applied to a slide valve type screw compressor, it can control the suction volume of the compressor in such a manner as to open a radial port at or in the vicinity of a position at which a closed space is initially formed, broadening the radial port in the direction in which the closed spaced is moved by rotation of rotors. Consequently, upon shifting the slide valve to an increasing degree, the suction volume of the compressor can be continuously correspondingly reduced. Thus, the present invention makes it possible to perform a smooth and continuous volumetric control from an initial stage even when the compressing gas is a light gas like hydrogen and helium gases.

Although the invention has been described in terms of specific embodiments, it is to be understood that other forms of the invention may be readily adapted within the scope of the invention.

What is claimed is:

1. A slide valve type screw compressor, comprising:

a slide valve with a surface of chevron shape in section and which further comprises a pair of arcuately curved surfaces forming part of the walls of a compression chamber accommodating a pair of intermeshed male and female screw rotors, said slide valve being slidable in the axial direction of a plurality of rotors for communicating said compression chamber with a suction port through an opening with an adjustably variable area for volumetric control of said compressor; and a suction casing communicating with said compression chamber, wherein a fore end of said slide valve is retractably protrudable into said suction casing and has opposite outer corner portions of said curved surfaces cut off at said fore end thereof at a predetermined angle with an axis thereof to provide rearwardly-directed substantially triangular sections at said fore end, said triangular sections and said arcuately curved surfaces meeting in curvilinear lines of intersection, said suction casing and said triangular sections comprising means for gradually initiating volumetric control of said compressor from an initial state of maximum volumetric flow by gradually withdrawing said triangular sections from said suction casing to expose increasing amounts of the lengths of said lines of intersection to fluid entering said compression chamber.

2. A slide valve type screw compressor as set forth in claim 1, wherein an appex end of said triangular section is located closer to said suction port than outer corner portions thereof.

3. A slide valve type screw compressor as set forth in claim 1, wherein said opposite corner portions of said curved surfaces are cut off at an angle greater than a lead angle of screw threads of said rotors.

4. A slide valve type screw compressor as set forth in claim 1, wherein said opposite corner portions at said front end of said curved surfaces are cut off along a zig-zag line.

5. A slide valve type screw compressor as set forth in claim 1, wherein said suction casing further comprises a stopper member for preventing displacement of said slide valve when said triangular sections are protruded into said suction casing.

6. A slide valve type screw compressor comprising:

a compression chamber;

a plurality of intermeshed threaded male and female screw rotors disposed in said compression chamber;

a suction casing communicating with said compression chamber; and a slide valve for adjustably varying said communication between said compression chamber and said suction casing to provide volumetric control of said compressor, wherein said slide valve further comprises a pair of arcuately curved surface forming a chevron shape and forming part of the walls of said compression chamber, and said slide valve further comprises a main portion and a fore extension meeting at an interface thereof, said main portion comprising end faces formed at said interface, said end faces having lines of intersection with said arcuately curved surfaces that incline rearwardly substantially in the direction of said threads of said screw rotors, said fore extension and said end faces being retractably protrudable into said suction casing, said suction casing and said end faces comprising means for gradually initiating volumetric control of said compressor from an initial state of maximum volumetric flow by gradually withdrawing said end faces from said suction casing to expose increasing amounts of the lengths of said lines of intersection to fluid entering said compression chamber.

7. A slide valve type screw compressor as set forth in claim 6, wherein the height of said end faces as measured normal to said fore extension is less than or equal to one half of the maximum dimension of said main portion of said slide valve as measured in the same direction.

* * * * *